US005211095A

United States Patent [19]

Chun et al.

[11] Patent Number: 5,211,095

[45] Date of Patent: May 18, 1993

[54] ARRANGEMENT ENABLING VARIABLY ORIENTED PUNCHING WITH EACH TOOL IN A MULTIPLE TOOL HOLDER

[75] Inventors: Victor Chun, Holland; James R. Hunter, Chadds Ford, both of Pa.

[73] Assignee: Murata Machinery, Limited, Japan

[21] Appl. No.: 933,399

[22] Filed: Aug. 20, 1992

[51] Int. Cl.[5] ..... B26F 1/08

[52] U.S. Cl. ..... 83/552; 83/618

[58] Field of Search ..... 83/552, 571, 618, 640, 83/34

[56] References Cited

U.S. PATENT DOCUMENTS 4,412,469 11/1983 Hirata et al. ..... 83/552
4,658,688 4/1987 Shah et al. ..... 83/552
4,929,276 5/1990 Chun et al. ..... 83/552
4,976,180 12/1990 Otto ..... 83/552
4,998,958 3/1991 Chun et al. ..... 83/552
5,048,385 9/1991 Eckert et al. ..... 83/34

*Primary Examiner*—Douglas D. Watts
*Assistant Examiner*—Scott A. Smith
*Attorney, Agent, or Firm*—John R. Benefiel

[57] ABSTRACT

A punch tool selection and orienting arrangement is disclosed in which a multiple tool holder and a rotary ram are separately driven to select and orient a single punch tool beneath the rotary ram for a punching operation. The rotary ram is also described as performing the tool selection process in disclosed embodiments in which a nonrotating tool carrier is used.

9 Claims, 3 Drawing Sheets

ARRANGEMENT ENABLING VARIABLY ORIENTED PUNCHING WITH EACH TOOL IN A MULTIPLE TOOL HOLDER

BACKGROUND OF THE INVENTION

This invention concerns punch holders for turret type punch presses, and more particularly multiple tool holders of a type described in U.S. Pat. No. 4,998,958.

U.S. Pat. No. 4,998,958 describes a punch tool holder carrying a number of punches, any one of which may be selected to be individually driven by the press ram.

It has also been heretofore known to mount individual punching tools to enable rotation to any of various desired orientations of the punching tool.

See U.S. Pat. No. 4,412,469 for an example of such a prior design.

U.S. Pat. No. 5,048,385 describes a tool holder capable of holding a number of punching tools any of which may be driven by the press ram.

In addition, the holder described therein is capable of positioning each tool at a desired orientation when engaged by the press ram. This is done by including a separately rotatable striker and tool carrier in the holder. The striker and tool carrier are rotated together to select a particular tool orientation and the striker separately rotated to select a particular tool.

This approach inherently requires sequentially staged rotation of the striker alone and the striker and carrier together, increasing the cycle time.

Furthermore, the tool holder is itself made more complicated by adding a striker to the holder in order to provide the variable tool orientation capability. Since many tool holders may be required to equip a turret type press, the increased costs of the more complicated holders can be significant.

Accordingly, an object of the present invention is to provide an arrangement for enabling a variable orientation of each tool in a multiple tool holder, which does not necessarily increase the cycle time or the complexity of the tool holder.

The multiple tool holders of the type shown in the above-referenced U.S. patents are typically installed in punch presses which already have indexing drives for rotating single punch holders to enable setting of various orientations of punches mounted in the press turret.

A disadvantage of multiple tool holders requiring rotation of the tool holder is that most older and some newer machines are not equipped with rotary indexing drives, which is impractical to add to existing machines.

Another object of the present invention is to provide a multiple tool holder and ram arrangement which does not require rotation of the tool holder to execute tool selection.

SUMMARY OF THE INVENTION

The present invention comprises an arrangement of an indexing ram combined with a separately driven rotary multiple tool holder. The tool holder is rotated to orient the tools in any desired angular position, while the ram is indexed to select the particular tool in the holder. The press table controls compensate for the variability of the tool location.

The separate indexing ram and rotary tool holder drives enable simultaneous execution of both tool selection and the setting of tool orientation to minimize cycle time.

A standard multiple tool holder is employed to avoid increased tooling costs, and the arrangement is also compatible with single tool holders.

A rotary ram can be employed with stationery multiple tool carriers configured to carry out the tool selection process without the need to add indexing drives for the tool carriers.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
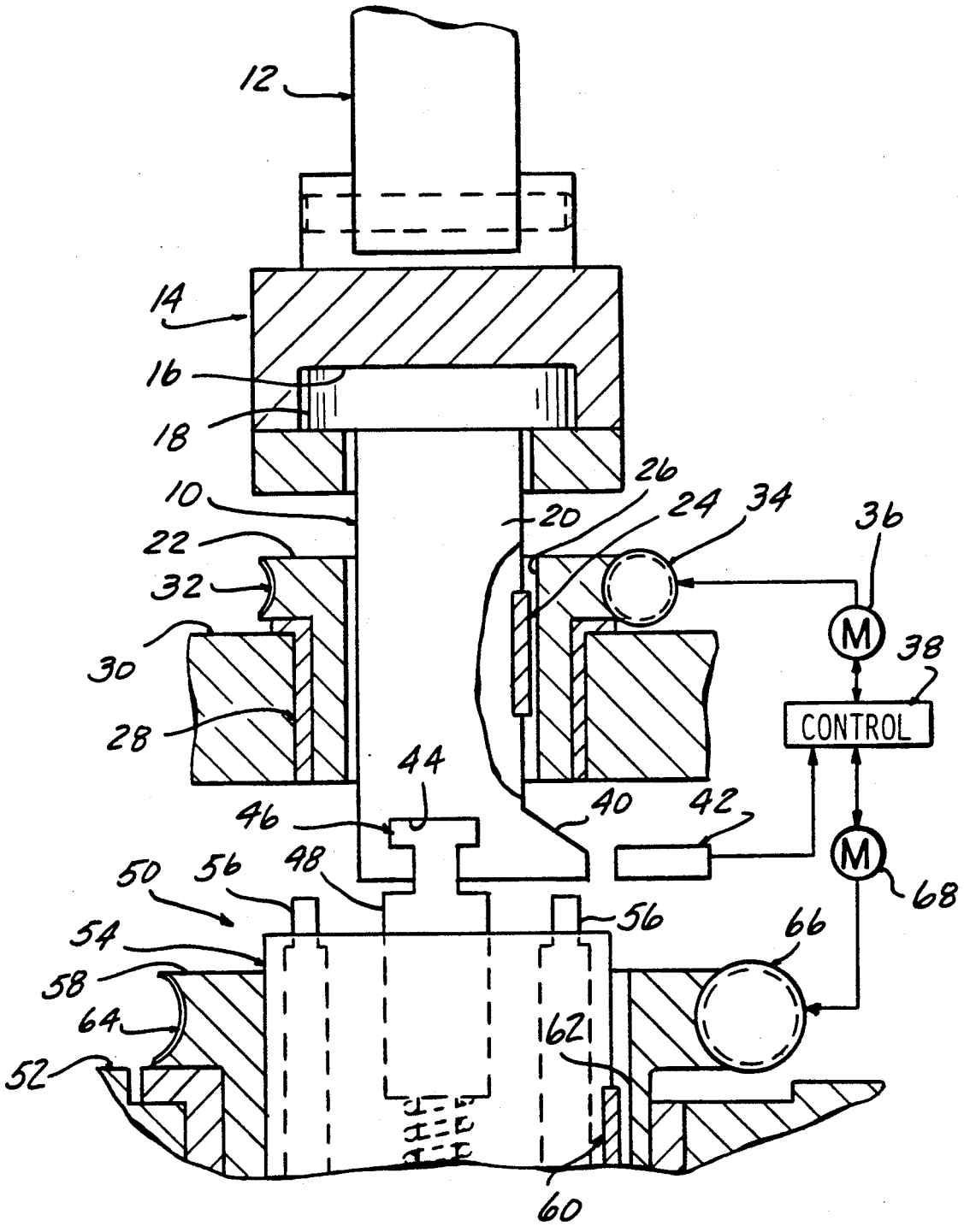
FIG. 1 is a fragmentary partially sectional elevational view of an arrangement according to the present invention together with adjacent press structure, and a diagrammatic representation of drive controls included in the arrangement.

Referring to FIG. 1, the arrangement according to the present invention includes a rotary ram 10 coupled to the press rod 12 by means of a ram connector 14 pinned to the end of the press actuator 12. The connector 14 is formed with a recess 16 retaining a flanged end 18 of the rotary ram 10 so as to allow rotation therein.

The rotary ram includes a main body portion 20 which is slidably received in a bore formed in a ram bushing 22. A key 24 and key way 26 prevent rotation of the rotary ram 10 in the ram bushing bore while accommodating the vertical sliding movement therein.

The ram indexing bushing 22 is itself received in a bushing 28 seated in a bore in a portion of the press frame 30.

A worm gear 32 is affixed or integral with the ram indexing bushing 22 and engaged with a worm 34 rotated by a drive motor 36 providing a control 38 with a position feedback signal.

The lower end of the rotary ram 10 is formed with an engagement feature 40 comprised of a radial protuberance which is variably positioned in indexed angular positions by operation of the drive motor 36. A proximity switch 42 or other suitable sensor provides a homing or zero position signal to the control 38.

The lower end of the rotary ram 10 is formed with a tee slot 44 adapted to receive a tee head 46 of a drive member 48 of each of a plurality of multiple tool holder 50 arranged in a circumferential array about the perimeter of an upper turret 52 of the press. Thus, as the upper turret 52 is rotated, each tee head 46 of each holder in the array successively passes into the tee slot 44 to in turn be coupled to the rotary ram 10.

The tool holder 50 comprises a multiple tool holder as described in U.S. Pat. No. 4,998,958 issued on Mar. 12, 1991, for a "Multi-tool Punch Holder," which is incorporated by reference herein. U.S. Pat. No. 4,929,276 shows a variation of such a design which is also suitable.

Figure 2:
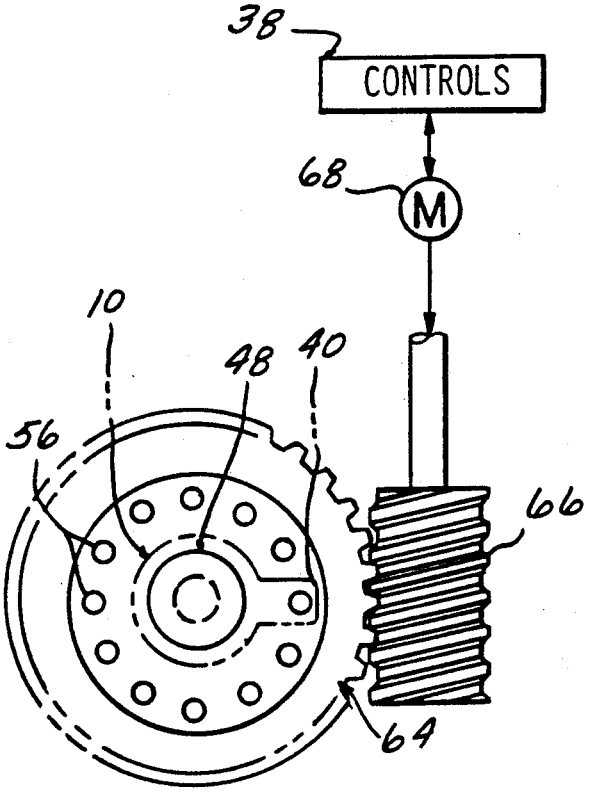
FIG. 2 is a plan view of a tool holder incorporated in the arrangement of FIG. 1, with a diagrammatic representation of the associated drive and control.

The tool holder 50 includes a cylindrical holder body 54 which carries a circular array of elongated punching tools, the stem ends 56 visible in FIG. 1 and 2. The holder body 54 is slidable vertically in a rotary holder bushing 58 but rotationally fixed by a key 60 and keyway 62.

A worm gear 64 is affixed or integral with a flange portion of the bushing 58, driven by a worm 66 and drive motor 68. The drive motor 68 is equipped with position feed back as indicated.

The bushing 58 is in turn rotatably supported in an outer bushing received in a bore in the press upper turret 52.

Further details of the tool holder 50 are set out in the above U.S. patents.

It shall be understood by those skilled in the art that the corresponding mating dies are mounted in a carrier cylinder rotatable bore in a lower turret of the press which carrier cylinder is rotated with a punch tool holder to keep each punch aligned and similarly oriented to a corresponding die. This can be done with a common drive or with suitable controls over independent drive means.

In operation, the orientation of the punch tools is set by rotating the tool holder 50 until the desired orientation is reached. In the meantime, the ram 10 is rotated to a spot where the desired tool is to be located, such that both selection processes can be accomplished simultaneously.

The controls 38 will operate the table controls to position the sheet material so as to take into account the actual variable X-Y position of the punch and die set to be used.

Referring to FIGS. 3–6, the rotating ram is shown combined with a nonrotational tool holder for a tool selection function only.

Figure 3:
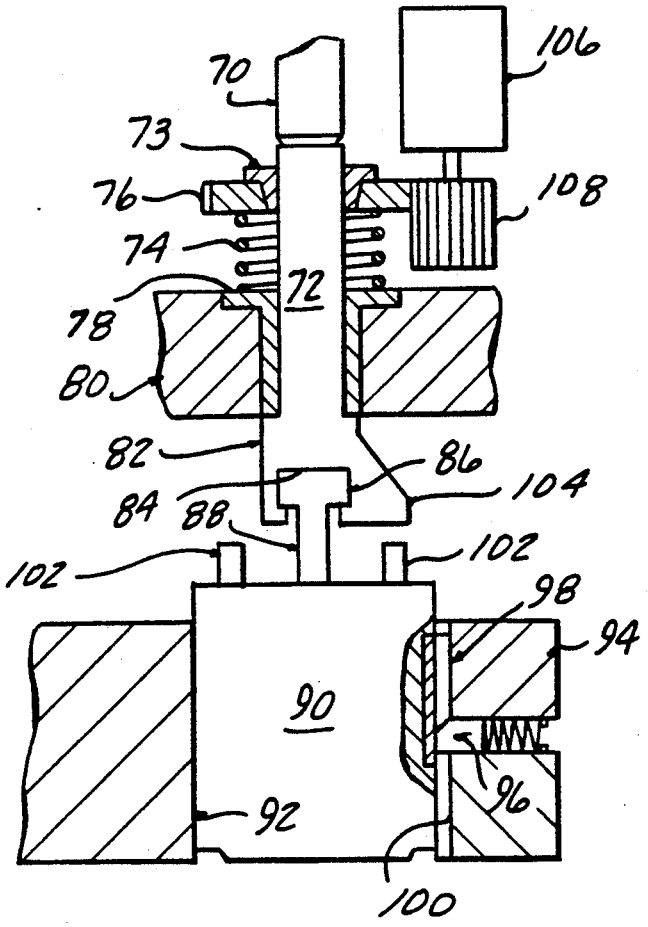
FIG. 3 is a fragmentary partially sectional view of a rotary ram and stationary multiple tool holder installed in a press.

FIG. 3 shows a striking actuator 70 connected to be stroked by the press drive (not shown). A rotary ram 72 is mounted aligned beneath the actuator 70 with its upper end position to be engaged and downwardly advanced against the upward bias of the lifter spring 74 interposed between a gear 76 clamped to the rotary ram 72 with a clamping cone 73 and a flanged bushing 78 recessed into the machine frame 80.

The lower end 82 of the rotary ram 72 is formed with a tee slot 84 adapted to mate with a tee head 86 of an actuating plunger 88 of a rotationally stationary tool carrier 90.

The tool carrier 90 is slidably received in a bore 92 of the press upper turret 94, releasably held in a retracted or up position by a spring loaded plunger 96 having a ramp surface engaged with a ramp surface on the end of a key 98 attached to the outside diameter of the tool holder 90. The key 98 slides in a keyway 100 in the bore of the upper turret 94 receiving the tool carrier 90.

The tool carrier 90 is configured as described in U.S. Pat. No. 4,998,958, omitting the rotary index sleeve and bushing elements as shown in that patent. A circular array of punching tools is carried in the holder 90, the stems 102 thereof protruding to project upwardly. In this position, a selected one of the punches can be contacted with a radial feature 104 formed on the lower end 82 of the rotary ram 72.

When the actuator 70 is driven down, the tool carrier 90 is also driven down overcoming the restraint of the plunger 96 by the force exerted by the rotary ram 72 until the bottom face contacts the workpiece and is stopped. The plunger 88 continues down against the resistance of a stripper spring to enable the feature 104 to contact and drive the punch through the workpiece, as described in U.S. Pat. No. 4,998,958.

Tool selection is executed by a drive motor 106, having an output shaft fixed to a pinion 108 rotating gear 76 to rotate the feature 104 to a selected tool stem 102.

Figure 4:
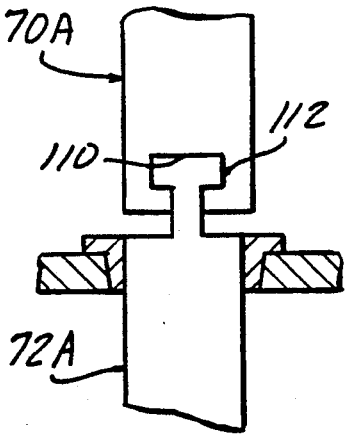
FIG. 4 is a fragmentary view of a portion of the rotary ram arrangement of FIG. 3 depicting an alternate ram drive connection.

FIG. 4 shows an alternate engagement between the actuator 70A and the upper end of the rotary ram 72A comprised of a tee slot 110 in the actuator 70A and a tee head 112 on the rotary ram 72A, eliminating the need for the lifter spring 74.

Figure 5:
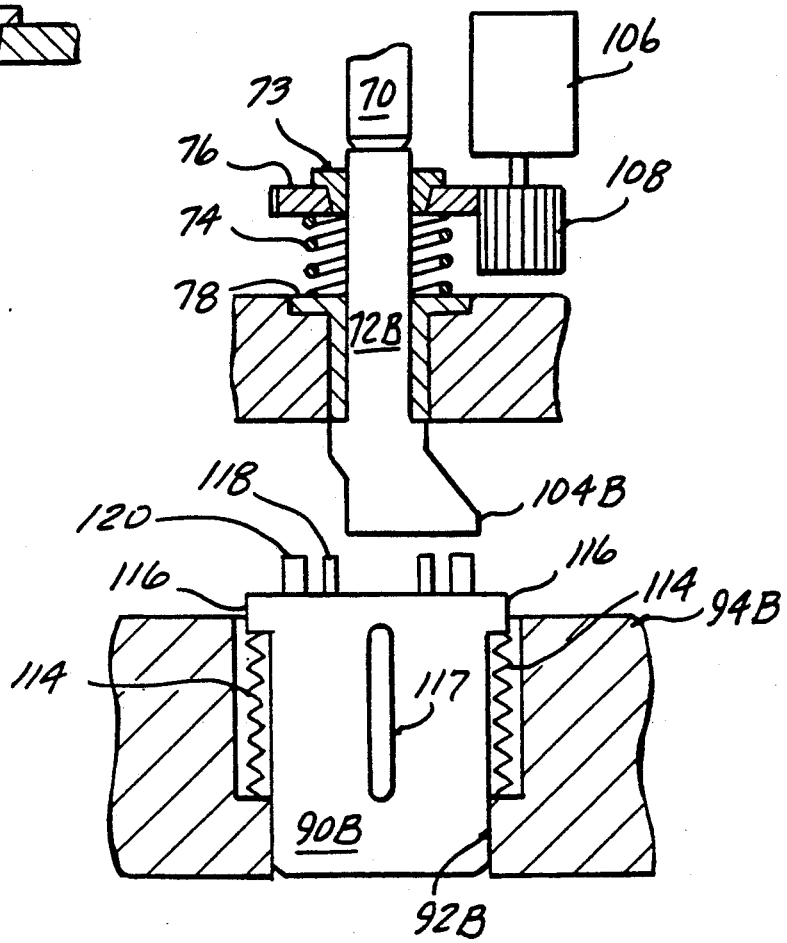
FIG. 5 is a fragmentary partially sectional view of an alternate embodiment of the rotary ram stationary holder of FIG. 3.

FIG. 5 shows a modified rotary ram 72B and further modified tool carrier 90B which eliminates the tee coupling to substitute a push only engagement of the lower end 104B of the ram 72B and tool carrier 90B.

The tool carrier 90B is mounted for downward sliding movement in bore 92B against the force of compression springs 114 disposed in surrounding pockets in the turret 94B beneath respective ears 116.

A key 117 sliding in a mating keyway (not shown) prevents rotation.

Figure 6:
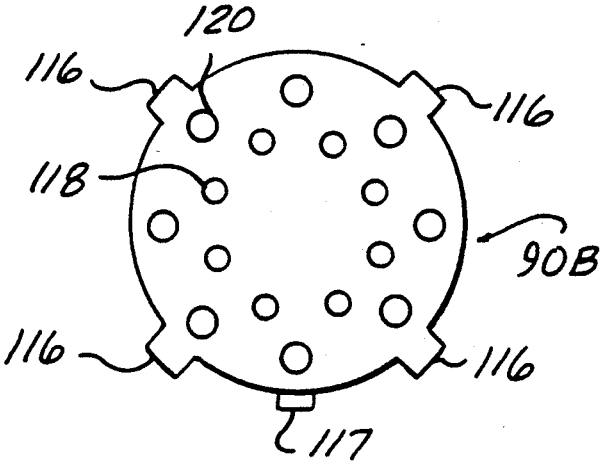
FIG. 6 is a plan view of the tool pattern of the holder of FIG. 5.

FIG. 6 shows staggered rows of smaller and larger punches 118, 120, arranged in concentric circles with the radial feature 104B configured to engage only one at each position thereof as the rotary ram 72B is rotated.

The rotary ram 72B is relatively easily adapted to existing machines and thus provides the increased capacity multiple tool holders to older presses.

Conventional, multiple tool, and indexing multiple tool holders can be interchanged.

A simple rapid angular position and tool selection process and holder are provided.

We claim:

1. A punching tool selection and orienting arrangement for a punch press having a vertically movable actuator member, a punch press frame, and a tool support structure comprising:

a tool holder mounted in said tool support structure for rotation about an axis thereof, said tool holder having an array of elongated punching tools disposed about said axis of rotation, said punching tools each having a stem portion protruding above said tool holder and supported to allow downward punching motion with said stem portion engaged to be driven downwardly;

orienting drive means for controllably rotating said tool holder about said axis to orient said tools in any angular orientation thereof;

an elongated rotary ram adapted to be aligned beneath one end of said actuator member to enable said rotary ram to be advanced thereby;

support means supporting said rotary ram on said punch press frame for rotation about a longitudinal axis of said rotary ram while allowing sliding movement in the direction of said longitudinal axis;

the other end of said rotary ram having a radially projecting feature adapted to be aligned with each individual punch tool stem respectively in correspondence to a rotated position of said rotary ram; and selection drive means independent of said orienting drive means controllably rotating said rotary ram to respective indexed positions, each of said indexed positions corresponding to an alignment of said radial feature with each one of said punch tool stem, whereby each of said tools can be oriented in a selected angular orientation by operation of said orienting drive means and any punch tool can be selectively aligned with said radial feature of said rotary ram by operation of said selection drive means.

2. The arrangement of claim 1 wherein said punch press tool support structure comprises a rotary turret operable to bring said tool holder aligned beneath said other end of said rotary ram.

3. The arrangement of claim 2 wherein said support means for said rotary ram comprises a bushing supported on said press frame having a bore slidably receiving said rotary ram, with means preventing rotation therein.

4. The arrangement of claim 3 wherein said selection drive means comprises a selection drive motor and interposed gearing means causing rotation of said bushing upon operation of said selection drive means.

5. The arrangement of claim 4 wherein said orienting drive means includes an orienting drive motor and interposed gearing means causing rotation of said tool holder upon operation of said orienting drive means.

6. A punching tool selection arrangement for a punch press having a vertically movable actuator member, a punch press frame, and a tool support turret comprising:

a tool holder mounted in said turret for rotation about an axis thereof, having an array of elongated punching tools about said axis of rotation, said punching tools each having a stem portion protruding above said tool holder and supported to allow downward punching motion with said stem portion engaged to be driven downwardly;

an elongated rotary ram adapted to be aligned beneath one end of said actuator member to enable said rotary ram to be advanced thereby;

support means supporting said rotary ram on said punch press frame for rotation about a longitudinal axis of said rotary ram while allowing sliding movement in the direction of said longitudinal axis;

the other end of said rotary ram having a radially projecting feature aligning with each individual punch tool stem respectively in correspondence to a rotative position of said rotary ram; and selection drive means controllably rotating said rotary ram to indexed positions corresponding to an alignment of said radial feature with each punch tool stem, any punch tool can be selectively aligned with said radial feature of said rotary ram by operation of said selection drive means.

7. The arrangement according to claim 6 wherein said tool holder is mounted in said turret for vertical movement against the force of lifter springs interposed beneath said tool holder.

8. The arrangement according to claim 6 wherein said ram support means comprises a bushing mounted in said press frame slidably but not rotatively receiving said rotary ram, wherein said selection drive means comprises a drive motor and gearing means interposed between said bushing and said drive motor.

9. The arrangement according to claim 6 wherein said punching tools are arranged in rows forming concentric circles, staggered with respect to each other, said radial feature configured to overlie alternately punching tools in either row upon rotation of said rotary ram means.

* * * * *